US006474440B2

(12) United States Patent
Kato

(10) Patent No.: US 6,474,440 B2
(45) Date of Patent: Nov. 5, 2002

(54) DIAPHRAGM FOR SPEAKER AND SPEAKER DEVICE PROVIDED WITH THE SAME

(75) Inventor: Toshifumi Kato, Yamagata (JP)

(73) Assignee: Pioneer Corporation, Yamagata (JP)

( * ) Notice: Subject to any disclaimer, the term of this patent is extended or adjusted under 35 U.S.C. 154(b) by 42 days.

(21) Appl. No.: 09/749,654

(22) Filed: Dec. 28, 2000

(65) Prior Publication Data

US 2001/0004954 A1 Jun. 28, 2001

(30) Foreign Application Priority Data

Dec. 28, 1999 (JP) ..... 11-374823

(51) Int. Cl.[7] ..... G10K 13/00
(52) U.S. Cl. ..... 181/161; 181/171; 381/423
(58) Field of Search ..... 181/157, 161, 181/164, 167, 168, 169, 170, 171, 172, 173; 381/398, 403, 423, 424, 430, 431, 432

(56) References Cited

U.S. PATENT DOCUMENTS 4,881,617 A * 11/1989 Faraone ..... 181/164
6,026,929 A * 2/2000 Faraone ..... 181/173
6,130,955 A * 10/2000 Aigner et al. ..... 381/803

* cited by examiner

*Primary Examiner*—Khanh Dang
(74) *Attorney, Agent, or Firm*—Sughrue Mion, PLLC

(57) ABSTRACT

A diaphragm for a speaker and a speaker device, a frequency characteristic as well as the endurance against input of which are improved, have been provided. A convexo-concave portion is radially formed at a neck of the diaphragm, which is stuck to a voice coil bobbin, to increase an adhesion area of the neck itself, thereby the endurance against input is improved. In addition, the neck is stuck to the voice coil bobbin by an adhesive to increase the mechanical strength of the neck itself, thereby a frequency characteristic as well as the endurance against input are improved.

10 Claims, 3 Drawing Sheets

DIAPHRAGM FOR SPEAKER AND SPEAKER DEVICE PROVIDED WITH THE SAME

BACKGROUND OF THE INVENTION

1. Field of the Invention

This invention relates to a diaphragm for a speaker, endurance against input of which is improved, particularly suitable for an on vehicle use and to a speaker device provided with the diaphragm.

2. Description of the Related Art

A cone speaker is most widely used among many types of speaker and used for a variety of purposes such as a television set, radio, on-vehicle system and hi-fi system.

FIG. 4 illustrates a basic structure of a conventional cone speaker, in which the central part is supported by a damper 44 and the peripheral part is supported by a frame 46 through an edge 45. Since the edge 45 functions as a spring to return a back-and-forth movement of the cone-type diaphragm 42, it is designed so as not to disturb an oscillation of the diaphragm. A voice coil 41, which is inserted in a magnetic gap of a magnetic circuit constituted by a magnet, plate and yoke, is applied with a current to oscillate the cone-type diaphragm 42, thereby generating a sound.

A neck of the cone-type diaphragm 42 is connected to the voice coil 41 by using an adhesive 43. Consequently, in response to a drive of the voice coil 41, a force in a direction of peeling the adhesive 43 off is always applied, causing a problem of endurance against input when a large volume is outputted from an amplifier (not shown in the figure). In some case, the adhesive is deteriorated to peel off, causing the diaphragm not to function.

Moreover, with use for a long period of time, the adhesive strength at the neck of the cone-type diaphragm 42 deteriorates, therefore the resonance sharpness of the cross-over oscillation of the cone-type diaphragm 42 increases generating sharp maximum and minimum in the frequency characteristic, causing a disadvantage for obtaining a flat frequency characteristic in terms of audibility.

SUMMARY OF THE INVENTION

It is therefore an objective of the present invention to solve the above problem and provide a diaphragm for a speaker, endurance against input of which is improved.

It is another objective of the present invention to provide a speaker device, a frequency characteristic as well as the endurance against input of which are improved.

In order to attain the above objective, the present invention is to provide a diaphragm for a speaker comprising a convexo-concave portion radially formed at a neck of the diaphragm, the neck being. stuck to a voice coil bobbin.

The present invention is also to provide a speaker device provided with a diaphragm, a neck of the diaphragm being stuck to a voice coil bobbin, comprising a convexo-concave portion radially formed at the neck that is stuck to the voice coil bobbin by an adhesive.

Preferably, the diaphragm is a cone-type diaphragm.

Preferably, the convexo-concave portion is radially formed over the whole circumference of the neck.

Preferably, the cone-type diaphragm comprises: a first cone-shaped part moving in the direction nearer to the voice coil in a range from the neck up to a predetermined position of the diaphragm with respect to an oscillating direction of the diaphragm; and a second cone-shaped part moving in the direction away from the voice coil in a range from the predetermined position up to an edge of the diaphragm.

Preferably, the diaphragm is a plane diaphragm.

According to the construction described above, the convexo-concave portion is radially formed at the neck of the diaphragm for a speaker and the adhesive hardened in the convexo-concave shape is adhesively provided to the voice coil, to which the neck is connected, thereby an adhesion area of the neck is increased to increase the adhesive strength and the endurance against input is improved. Moreover, the mechanical strength of the neck of the diaphragm is increased, thereby the crossover resonance of the cone-type diaphragm is restricted and the frequency characteristic is improved.

DESCRIPTION OF THE PREFERRED EMBODIMENTS

In the following, the preferred embodiment of the present invention will be explained with reference to the attached drawings.

Figure 1:
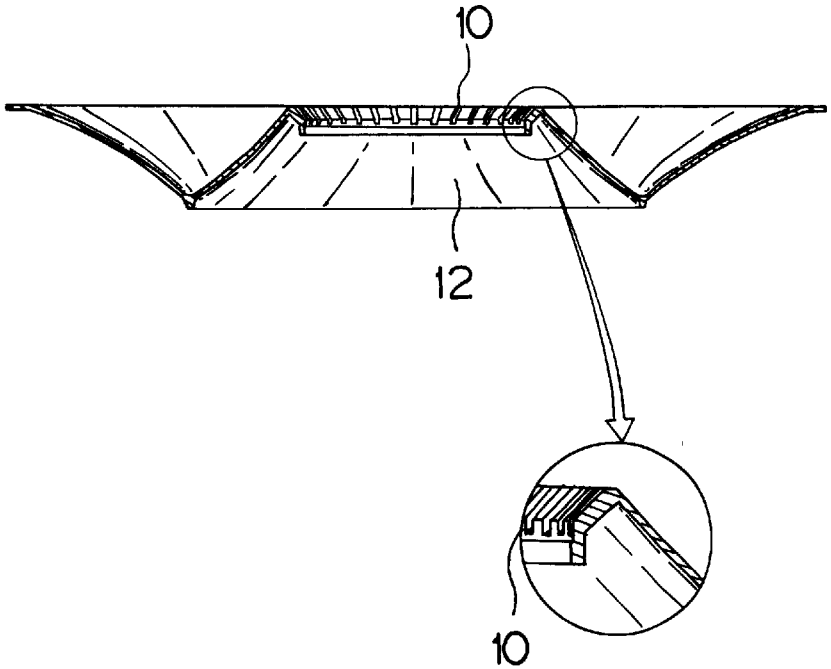
FIG. 1 illustrates a sectional view of a neck of a diaphragm for a speaker according to the present invention.
Figure 2:
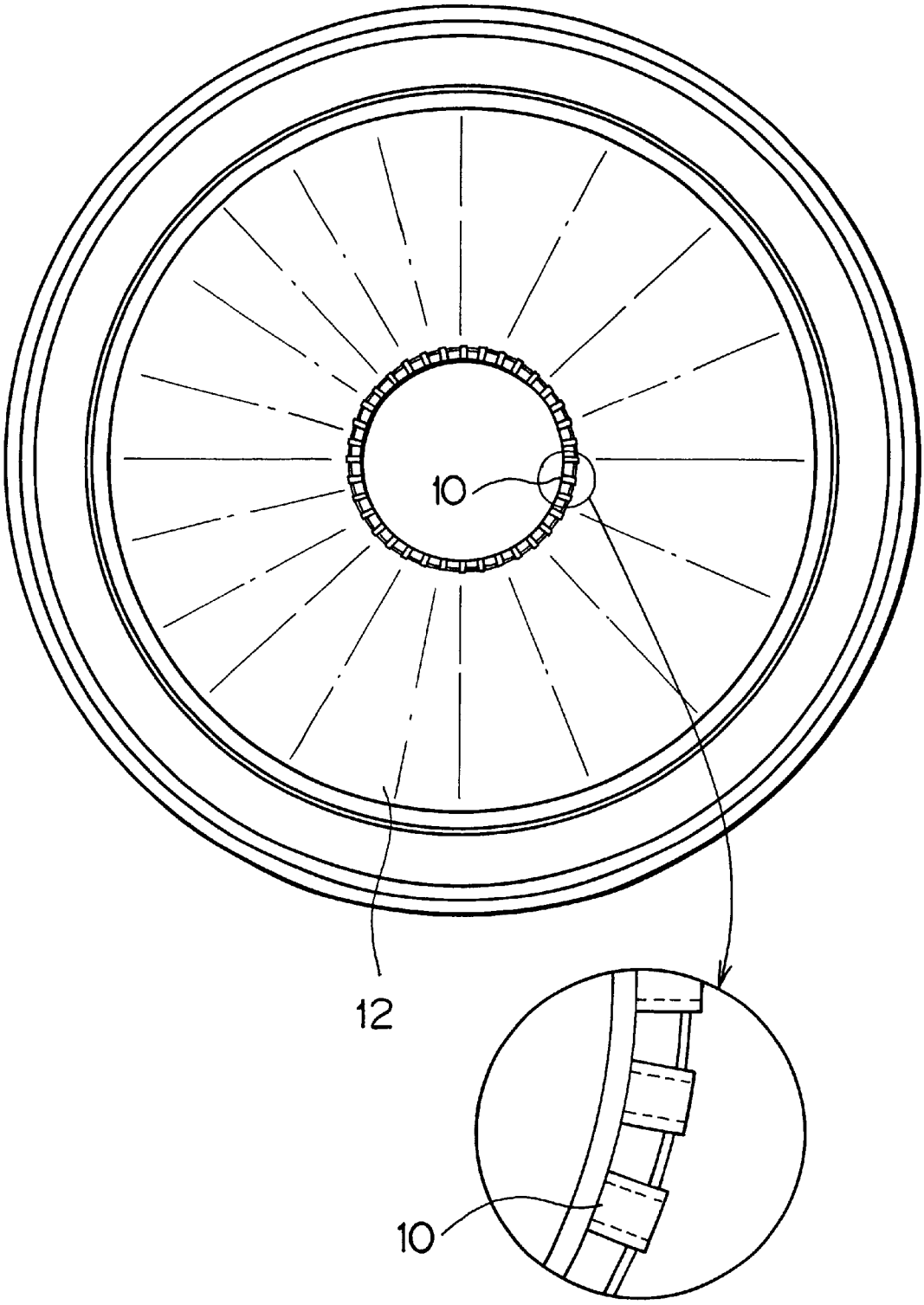
FIG. 2 illustrates a plan view of a diaphragm for a speaker according to the present invention.
Figure 4:
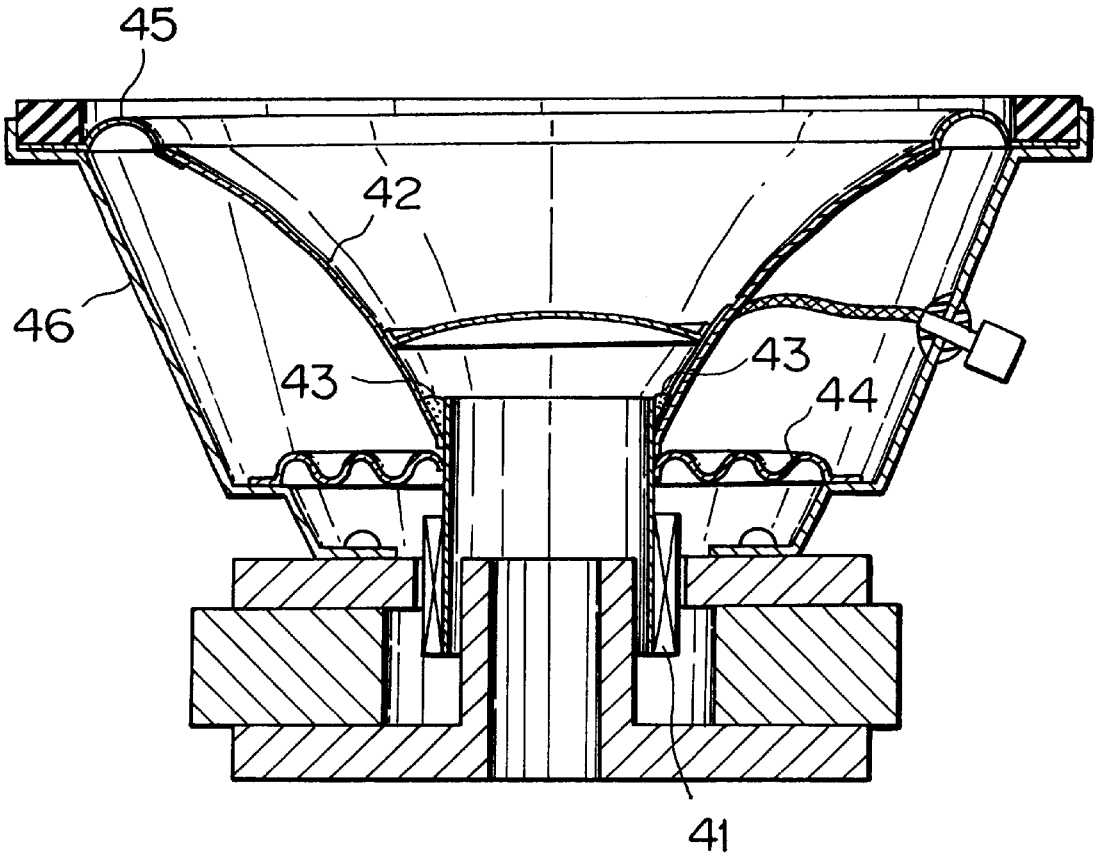
PRIOR ART FIG. 4
FIG. 4 illustrates a sectional view of a conventional cone speaker.

FIGS. 1 and 2 illustrate a sectional view of a neck of a diaphragm and a plan view thereof, respectively, for a speaker according to the present invention, in which a cone-type diaphragm 12 is shown as a diaphragm for a speaker.

As shown in FIGS. 1 and 2, a convexo-concave portion is radially formed over the whole circumference of the neck that is stuck to a voice coil bobbin of the cone-type diaphragm 12. In this preferred embodiment, grooves 10 are employed as the convexo-concave portion and many grooves 10 are formed over the whole circumference of the neck.

A detailed structure of the groove 10 is shown with enlarging partially in each figure. The cone-type diaphragm 12 comprises: a first cone-shaped part moving in a direction nearer to the voice coil in a range from the neck up to a predetermined position of the diaphragm with respect to an oscillating direction of the diaphragm; and a second cone-shaped part moving in a direction away from the voice coil in a range from the predetermined position up to an edge of the diaphragm.

Figure 3:
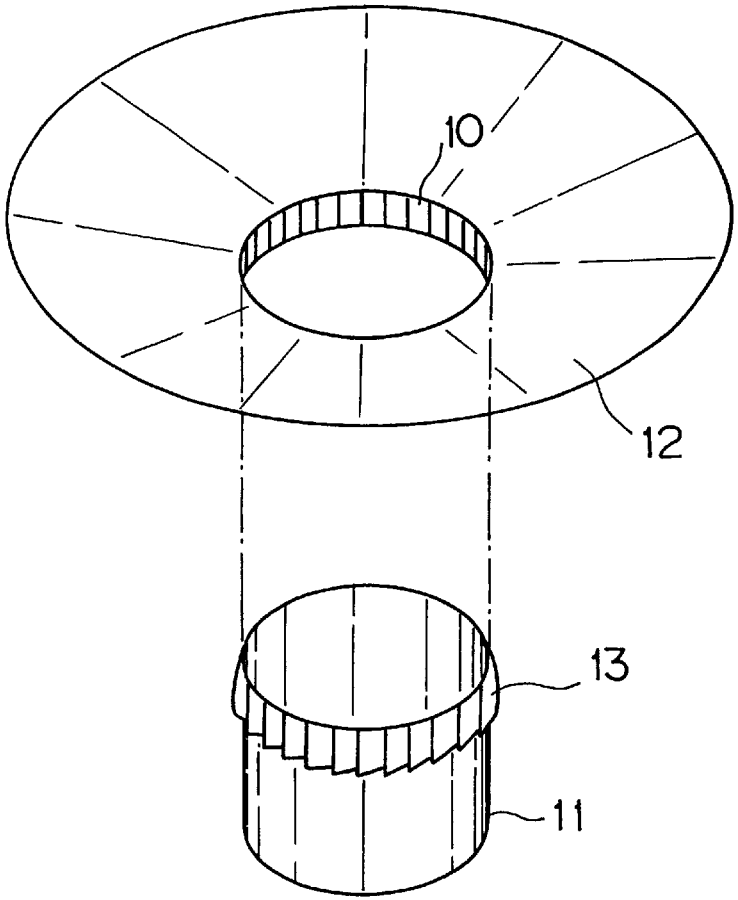
FIG. 3 illustrates a portion corresponding to a neck of a cone-type diaphragm in a disassembled voice coil according to the present invention.

FIG. 3 shows a portion of adhesion between the cone-type diaphragm 12 and a voice coil bobbin 11, in which only. a portion corresponding to the neck of the cone-type diaphragm in a disassembled voice coil. A hardened adhesive 13 is adhesively provided to a portion corresponding to the grooves formed at the neck of the. cone-type diaphragm 12, therefore the adhesive 13 is hardened in the convexo-concave shape according to the neck of the cone-type diaphragm 12, thereby the adhesion area increases. Then, the adhesive strength increases and the mechanical strength of the neck itself of the diaphragm increases.

As explained above, according to the present invention, the convexo-concave portion is radially formed at the neck of the diaphragm, which is stuck to the voice coil bobbin, to increase the adhesion area of the neck itself, thereby the endurance against input is improved. In addition, the neck is stuck to the voice coil bobbin 11 by the adhesive 13 to increase the mechanical strength of the neck itself, thereby a frequency characteristic as well as the endurance against input are improved.

In this preferred embodiment, only an example of grooves 10 are explained as one of the means to provide the neck of the diaphragm with the convexo-concave portion radially. Instead of the grooves, ribs and the like may be employed to increase the adhesion area of the neck. Also, in this preferred embodiment, only an example of a cone-type diaphragm 12 is explained as a diaphragm, instead, the present invention can similarly be applied to a plane diaphragm and the like.

The aforementioned preferred embodiments are described to aid in understanding the present invention and variations may be made by one skilled in the art without departing from the spirit and scope of the present invention.

As explained above, according to the present invention, a convexo-concave portion is radially formed at a neck of a diaphragm for a speaker and the neck is stuck to a voice coil bobbin by an adhesive, thereby an adhesion area of the neck is increased and the endurance against input is improved.

Furthermore, since the mechanical strength of the neck itself of the diaphragm is increased, thereby the crossover resonance of the cone-type diaphragm is restricted and the frequency characteristic of the diaphragm is improved.

What is claimed is:

1. A diaphragm for a speaker comprising:

a neck adhesively attached to a voice coil bobbin of said speaker; and a convexo-concave portion radially formed within said neck of the diaphragm, wherein adhesive placed within said convexo-concave portion, and between said neck and said voice coil bobbin secures said diaphragm to said voice coil bobbin.

2. The diaphragm for a speaker according to claim 1, wherein the diaphragm is a cone-type diaphragm.

3. The diaphragm for a speaker according to claim 1, wherein the convexo-concave portion is radially formed over the complete circumference of the neck.

4. The diaphragm for a speaker according to claim 1, wherein the diaphragm is a plane diaphragm.

5. A speaker device having a diaphragm, said diaphragm comprising:

a neck adhesively attached to a voice coil bobbin of said speaker; and a convexo-concave portion radially formed within the neck of said diaphragm, wherein adhesive is placed within said convexo-concave portion, and between said neck and said voice coil bobbin to secure said diaphragm to said voice coil bobbin.

6. The speaker device according to claim 5, wherein the diaphragm is a cone-type diaphragm.

7. The speaker device according to claim 5, wherein the convexo-concave portion is radially formed over the complete circumference of the neck.

8. The speaker device according to claim 5, wherein the diaphragm is a plane diaphragm.

9. A diaphragm for a speaker comprising:

a neck adhesively attached to a voice coil bobbin of said speaker; and a convexo-concave portion radially formed within said neck of the diaphragm, wherein adhesive placed within said convexo-concave portion, and between said neck and said voice coil bobbin secures said diaphragm to said voice coil bobbin, wherein the diaphragm is a cone-type diaphragm, wherein the cone-type diaphragm comprises:

a first cone-shaped part extending outwardly from the neck to a predetermined position of the diaphragm; and a second cone-shaped part extending inwardly from the predetermined position to an edge of the diaphragm.

10. A speaker device having a diaphragm, said diaphragm comprising:

a neck adhesively attached to a voice coil bobbin of said speaker; and a convexo-concave portion radially formed within the neck of said diaphragm, wherein adhesive is placed within said convexo-concave portion, and between said neck and said voice coil bobbin to secure said diaphragm to said voice coil bobbin, wherein the diaphragm is a cone-type diaphragm, wherein the cone-type diaphragm comprises:

a first cone-shaped part extending outwardly from the neck to a predetermined position of the diaphragm; and a second cone-shaped part extending inwardly from the predetermined position to an edge of the diaphragm.

* * * * *